US008092619B2

(12) United States Patent
Kuniyoshi et al.

(10) Patent No.: US 8,092,619 B2
(45) **Date of Patent: *Jan. 10, 2012**

(54) R-T-CU-MN-B TYPE SINTERED MAGNET

(75) Inventors: Futoshi Kuniyoshi, Osaka (JP); Rintaro Ishii, Osaka (JP); Hiroyuki Tomizawa, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/996,828

(22) PCT Filed: Jun. 11, 2009

(86) PCT No.: PCT/JP2009/002648

§ 371 (c)(1),
(2), (4) Date: Dec. 8, 2010

(87) PCT Pub. No.: WO2009/150843

PCT Pub. Date: Dec. 17, 2009

(65) Prior Publication Data

US 2011/0095855 A1 Apr. 28, 2011

(30) Foreign Application Priority Data

Jun. 13, 2008 (JP) ..... 2008-155473

(51) Int. Cl.
*H01F 1/057* (2006.01)

(52) U.S. Cl. ..... 148/302; 148/103; 419/12

(58) Field of Classification Search ..... None
See application file for complete search history.

(56) References Cited

U.S. PATENT DOCUMENTS

| | | | | |
|---|---|---|---|---|
| 4,770,723 | A | 9/1988 | Sagawa et al. | |
| 4,859,255 | A | 8/1989 | Fujimura et al. | |
| 7,740,715 | B2 * | 6/2010 | Tomizawa | 148/302 |
| 7,789,933 | B2 * | 9/2010 | Tomizawa | 75/244 |
| 2001/0023716 | A1 | 9/2001 | Hirosawa et al. | |
| 2008/0271821 | A1 * | 11/2008 | Tomizawa | 148/302 |

(Continued)

FOREIGN PATENT DOCUMENTS

JP 01-219143 A 9/1989

(Continued)

OTHER PUBLICATIONS

Machine Translation Japanese Document No. 2003-183764, Jul. 3, 2003.*

English Translation of Japanese Patent Document 2003-183764 A1 (Published Jul. 3, 2003).*

(Continued)

*Primary Examiner* — John Sheehan

(74) *Attorney, Agent, or Firm* — Keating & Bennett, LLP

(57) ABSTRACT

An R-T-Cu—Mn—B based sintered magnet includes: 12.0 at % to 15.0 at % of R, which is at least one of the rare-earth elements that include Y and of which at least 50 at % is Pr and/or Nd; 5.5 at % to 6.5 at % of B; 0.08 at % to 0.35 at % of Cu; 0.04 at % to less than 0.2 at % of Mn; at most 2 at % (including 0 at %) of M, which is one, two, or more elements that are selected from the group consisting of Al, Ti, V, Cr, Ni, Zn, Ga, Zr, Nb, Mo, Ag, In, Sn, Hf, Ta, W, Au, Pb and Bi; and T as the balance, which is either Fe alone or Fe and Co and of which at most 20 at % is Co if T includes both Fe and Co.

7 Claims, 2 Drawing Sheets

U.S. PATENT DOCUMENTS

| | | | | |
|---|---|---|---|---|
| 2008/0274009 | A1* | 11/2008 | Tomizawa | 420/83 |
| 2011/0025440 | A1* | 2/2011 | Kuniyoshi et al. | 335/302 |

FOREIGN PATENT DOCUMENTS

| | | | |
|---|---|---|---|
| JP | 2003-183764 | A | 7/2003 |
| JP | 2004-303909 | A | 10/2004 |

OTHER PUBLICATIONS

Official Communication issued in corresponding International Patent Application No. PCT/JP2009/002648, mailed on Jan. 20, 2011.

Official Communication issued in International Patent Application No. PCT/JP2009/002648, mailed on Sep. 15, 2009.

* cited by examiner

R-T-CU-MN-B TYPE SINTERED MAGNET

TECHNICAL FIELD

The present invention relates to a rare-earth-transition metal-boron (R-T-B) based sintered magnet with high coercivity and good thermal resistance, which can be used effectively to make a motor, among other things.

BACKGROUND ART

When it comes to developing a permanent defect, the most difficult task is to determine how to generate coercivity. This is also true of an R-T-B based sintered magnet. That is why researches and developments are still carried on to find out exactly how the coercivity is generated.

In practice, several methods for increasing the coercivity of an R-T-B based sintered magnet are known. One of those methods is using a heavy rare-earth element (such as Dy or Tb, among other things) as one of the rare-earth elements as disclosed in Patent Document No. 1. However, only a limited amount of Dy or Tb can be added because Dy and Tb are rare and expensive elements and because an excessive amount of Dy or Tb added would interfere with forming a main phase when a material alloy is prepared.

Meanwhile, to increase the coercivity, not just such rare-earth elements but also various other elements have been added tentatively as well. For instance, Al or Cu is usually added as disclosed in Patent Document Nos. 2 and 3, respectively. However, these elements are regarded as contributing effectively to improving the metallic structure of a magnet, rather than the magnetic properties of an $R_2T_{14}B$ type compound that is a ferromagnetic phase. That is why even if a small amount of such an element is added, the coercivity would still increase. Among other things, Cu has the effect of relaxing considerably the conditions of heat treatment to be normally carried out on an R-T-B based sintered magnet after the sintering process. This is believed to be because Cu would be distributed in the form of a film over the interface between the main phase and the grain boundary phase and eliminate microscopic defect surrounding the main phase. If a lot of Cu were present, however, not only the remanence but also the coercivity would rather decrease. For that reason, only a limited amount of Cu can be added and the effect achieved by adding Cu has been marginal so far.

CITATION LIST

Patent Literature

Patent Document No. 1: Japanese Patent Application Laid-Open Publication No. 60-34005

Patent Document No. 2: Japanese Patent Application Laid-Open Publication No. 59-89401

Patent Document No. 3: Japanese Patent Application Laid-Open Publication No. 1-219143

SUMMARY OF INVENTION

Technical Problem

Lately, considering various environmental, energy and natural resources related issues, demands for high-performance magnets are increasing day after day. Meanwhile, to make an R-T-B based sintered magnet representative of such high-performance magnets, there is no choice but to count on the supply of a rare-earth element, which is one of its main ingredients, from only limited districts on the earth. On top of that, to make an R-T-B based sintered magnet with high coercivity, at least one of Tb and Dy, which are even rarer and even more expensive among those rare-earth elements, should be used a lot in the prior art.

It is well expected to those skilled in the art that the coercivity can be increased if the crystal grain size of an $R_2T_{14}B$ type compound, which is the main phase of an R-T-B based sintered magnet, is reduced. However, the coercivity cannot be increased so much even if the particle size of the pulverized powder is reduced, for example. This is believed to be because as the feature size of the texture is reduced, the interface between the main and grain boundary phases increases. As a result, Al, Cu and other elements that would improve the quality of the grain boundary phases effectively would run short, and therefore, it would be difficult to increase the coercivity significantly with the additive element. On top of that, the smaller the size of the material powder, the greater the surface energy. As a result, the abnormal grain growth could advance rather rapidly during the sintering process. And other problems are expected as well.

As for Cu, if the amount of Cu added were increased, then the Cu added would bond to the R component that should form the main phase to produce an R—Cu compound. As a result, the percentage of the main phase would decrease and the remanence $B_r$ would decline. That is why according to the conventional technique, the amount of Cu added cannot be increased.

It is therefore an object of the present invention to provide a technique for adding a greater amount of Cu than in the prior art to increase the coercivity of an R-T-B based magnet. A more specific object of the present invention is to provide a technique that will work fine when the feature size of a sintered texture is reduced.

Solution to Problem

An R-T-Cu—Mn—B based sintered magnet according to the present invention includes: 12.0 at % to 15.0 at % of R, which is at least one of the rare-earth elements that include Y and of which at least 50 at % is Pr and/or Nd; 5.5 at % to 6.5 at % of B; 0.08 at % to 0.35 at % of Cu; 0.04 at % to less than 0.2 at % of Mn; at most 2 at % (including 0 at %) of M, which is one, two, or more elements that are selected from the group consisting of Al, Ti, V, Cr, Ni, Zn, Ga, Zr, Nb, Mo, Ag, In, Sn, Hf, Ta, W, Au, Pb and Bi; and T as the balance, which is either Fe alone or Fe and Co and of which at most 20 at % is Co if T includes both Fe and Co.

In one preferred embodiment, the main phase of the magnet is an $R_2T_{14}B$ type compound.

In this particular preferred embodiment, the crystal grain size of the main phase is represented by an equivalent circle diameter of 12 μm or less.

In another preferred embodiment, the combined area of portions of the main phase, of which the crystal grain sizes are represented by equivalent circle diameters of 8 μm or less, accounts for at least 70% of the overall area of the main phase.

In an alternative preferred embodiment, the combined area of portions of the main phase, of which the crystal grain sizes are represented by equivalent circle diameters of 5 μm or less, accounts for at least 80% of the overall area of the main phase.

Advantageous Effects of Invention

By adding a predetermined amount of Mn to an R-T-B based sintered magnet, a greater amount of Cu can be added to the magnet than in the prior art, and the coercivity can be increased as a result. Such an effect can be achieved even more significantly if the feature size of the sintered texture is reduced.

DESCRIPTION OF EMBODIMENTS

Figure 1:
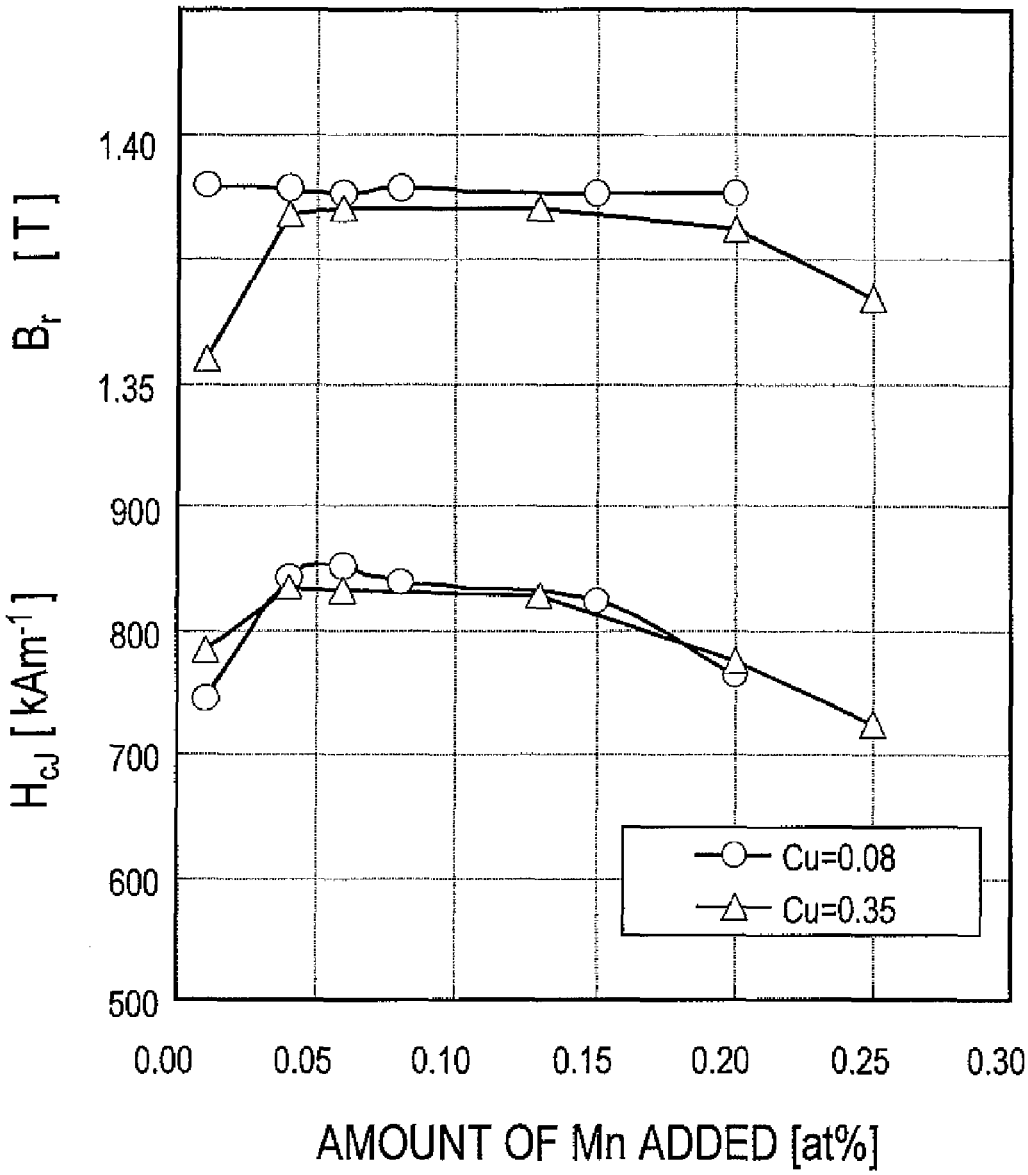
FIG. 1 shows how the magnetic properties of an Nd—Fe—Cu—Mn—B based sintered magnet vary with the amount of Mn added with respect to two different Cu mole fractions.

According to the present invention, by adding a predetermined amount of Cu to each unit area of the interface between the main and grain boundary phases, the degree of matching in the interface between the main and grain boundary phases is increased and great coercivity can be achieved as a result. Furthermore, even if the interface between the main and grain boundary phases increased significantly as the feature size of the sintered texture is reduced, the coercivity can still be increased effectively with the addition of Cu. Mn, which is an indispensable element according to the present invention, works to stabilize the main phase. And even if a greater amount of Cu is added than in the prior art, Cu will bond to R in the main phase to form an R—Cu compound. As a result, Mn works to maintain the volume percentage of the main phase without decomposing the main phase and to disperse Cu effectively over the interface between the main and grain boundary phases.

The present invention relates to an R-T-Cu—Mn—B based sintered magnet, which includes, as its main ingredients, a rare-earth element R, an iron group element T, B, Cu, Mn an additive element M, which is added as needed according to the intended application, and other inevitably contained impurities. Hereinafter, its composition will be described in detail.

The rare-earth element R is at least one element that is selected from the rare-earth elements including Y. To have the magnet of the present invention achieve good performance, the rare-earth element(s) R preferably accounts for 12.0 at % to 15.0 at % of the overall magnet.

The magnet of the present invention includes an $R_2T_{14}B$ type compound as its main phase. And the higher the percentage of the main phase, the higher the performance of the magnet will be. On the other hand, to achieve high coercivity, it is important to form a phase consisting mostly of R, which is called an "R-rich phase", on the grain boundary of the main phase and optimize the structure of the interface between the main phase and the grain boundary phase. Also, a part of R will produce an oxide or a carbide either by itself or in combination with other element(s). That is why in the magnet of the present invention, the lower limit of R is 12.0 at %, which is slightly greater than the R mole fraction of the composition that consists of the main phase alone. The reason is as follows. Specifically, if the mole fraction of R were less than 12.0 at %, then the concentration of the R-rich phase would be too low to achieve high coercivity as intended and it would be difficult to get sintering done, too.

On the other hand, if the R mole fraction exceeded 15.0 at %, then the volume percentage of the main phase inside the magnet, and eventually the magnetization of the magnet, would decrease. Furthermore, if R exceeded 15.0 at %, then abnormal grain growth would be produced easily during the sintering process and the coercivity might decrease as a result.

Of the rare-earth elements R, the four elements Pr, Nd, Tb and Dy can be used effectively to make the magnet of the present invention. Among other things, Pr or Nd is indispensable to realize a high-performance magnet because Pr or Nd will increase the saturation magnetization of the $R_2T_{14}B$ compound that is the main phase of this type of magnet. For that reason, according to the present invention, Pr and/or Nd accounts for 50 at % or more of R.

Tb and Dy can be used effectively to increase the coercivity of this type of magnet because the $R_2T_{14}B$ type compound has low magnetization but huge magnetocrystalline anisotropy. That is why Tb and Dy can also be added appropriately according to the present invention.

The other rare-earth elements cannot be used effectively on an industrial basis to improve the performance of the magnet. The reasons are as follows. Firstly, in the other rare-earth elements, the saturation magnetization of the main phase is smaller than in Pr or Nd. Secondly, there is a rare-earth element (such as Ho) that can certainly increase the coercivity but is very expensive. Meanwhile, La and Ce are often contained inevitably in the composition of a magnet because La and Ce are impurities to be included in the material of Pr and/or Nd. That is why La and Ce may be included in 3 at % or less because the properties of the magnet will be hardly affected by such a small amount of rare-earth elements.

T is either Fe alone or a combination of Fe and Co. The magnetization of the $R_2T_{14}B$ type compound is produced mostly by Fe and will hardly decrease even if a small amount of Co is added. Also, Co produces the effects of raising the Curie point of the magnet and improving the grain boundary structure of the magnet and increasing the corrosion resistance thereof, and therefore, can be added according to the intended use. In that case, Co is supposed to account for 20 at % or less of T. This is because if Co accounted for more than 20 at % or T, the magnetization would decrease significantly.

B is an indispensable element to form the main phase. The composition ratio of the main phase directly reflects the amount of B added. However, if B were added in more than 6.5 at %, then an extra B compound not contributing to forming the main phase would be produced and would decrease the magnetization. Meanwhile, if B were added in less than 5.5 at %, then the percentage of the main phase would decrease and not only the magnetization of the magnet but also its coercivity would decrease as well. That is why the amount of B added preferably falls within the range of 5.5 at % to 6.5 at %.

Cu is an indispensable element according to the present invention. If the composition distribution of the texture of an R-T-B based sintered magnet, to which Cu has been added, is observed with high zoom power, Cu can be seen to be distributed as a thin film over the interface between the main phase and the grain boundary phase. It is believed that this Cu combines with an adequate amount of oxygen to form an fcc structure, keeps matched to the crystal lattice of the main phase and eliminates the structural defects, thus increasing the coercivity. A magnet, of which the texture has no such films observed, would not achieve high coercivity.

If a heat treatment process is carried out after the sintering process as Cu is added, an interfacial film structure, including Cu, can be obtained and great coercivity can be generated. That is why as the area of the interface between the main and grain boundary phases of a magnet increases, the amount of Cu added should also be increased. However, in a conventional magnet to which a predetermined amount of Mn is not added, if a lot of Cu were added to such a magnet, the $R_2T_{14}B$ type compound that is the main phase would be deprived of R, the main phase would be decomposed and its amount would decrease. On the other hand, according to the present invention, it is possible to prevent the $R_2T_{14}B$ type compound that is the main phase from being decomposed by adding Mn, and therefore, great coercivity can be generated by adding a required amount of Cu.

Cu added should account for at least 0.08 at %, and accounts preferably for 0.1 at % or more, and more preferably 0.12 at % or more.

However, even if the effect to be described below is achieved by adding Mn but if the amount of Cu added were excessive, the remanence of the magnet would still decrease. That is why Cu should be added to account for at most 0.35 at %, more preferably 0.3 at % or less.

Mn is another indispensable element according to the present invention and an element that can produce a solid solution in the main phase and stabilize the $R_2T_{14}B$ type compound phase that is the main phase. According to the present invention, since the main phase can be stabilized by adding Mn, it is possible to prevent R, which should form the $R_2T_{14}B$ type compound that is the main phase, from bonding to Cu to form an R—Cu compound instead and decreasing the percentage of the main phase. As a result, a greater amount of Cu can be added than in the prior art. Consequently, even if the area of the interface increased significantly by reducing the crystal grain size, a sufficient amount of Cu can still be added and great coercivity can still be generated.

The effect described above can be achieved if Mn added accounts for at least 0.04 at %. The amount of Mn added accounts for preferably 0.06 at % or more, and more preferably 0.07 at % or more.

Meanwhile, Mn added would decrease the magnetization of the main phase and the anisotropic magnetic field. For that reason, if Mn were added excessively, then the performance of the magnet would rather decline. That is why the upper limit of Mn added is set to be less than 0.2 at % and preferably 0.15 at % or less.

The additive elements M are not indispensable but may be added in 2 at % or less unless the magnetization is decreased.

Among those additive elements M, Al contributes effectively to improving the physical properties of the grain boundary phase of this type of magnet and increasing the coercivity thereof. For that reason, Al is preferably added in 2 at % or less. This amount is preferred for the following reasons. Specifically, if the amount of Al added exceeded 2 at %, a lot of Al would enter the main phase and the magnetization of the magnet would decrease significantly, which is not beneficial. More preferably, Al is added in 1.5 at % or less. Al is included in a normally used B material and the amount of Al to add should be adjusted depending on how much Al is included in the B material. Also, to achieve the effects by adding Al, the amount of Al added is preferably 0.1 at % or more, and more preferably 0.4 at % or more.

When added, Ga, which is another additive element M, will increase the coercivity of the magnet effectively. Ga works particularly effectively if the composition of the magnet includes Co. However, as Ga is expensive, the amount of Ga added is preferably at most 1 at %. On top of that, Ga also achieves the effect of lowering the lower limit of the appropriate range of B added. And such an effect is achieved fully if Ga is added in 0.08 at % or less.

Among the various additive elements M, Ag, Au and Zn have similar functions and effects to Cu. However, Zn is volatile so easily that it is rather difficult to use Zn as intended. Meanwhile, probably because of their large atomic radius, Ag and Au seem to have a different interfacial structure between the main and grain boundary phases from Cu. Thus, these elements can also be added as well as Cu. However, if these elements were added excessively, the remanence would decrease. That is why these elements added preferably account for 0.5 at % or less. Ni will also achieve a similar effect but forms an $R_3Ni$ compound in the grain boundary phase. For that reason, when Ni is added, the degree of matching achieved in the interface between the main phase and the grain boundary phase will be somewhat lower than when Cu is added. That is to say, it is not so effective to add Ni as to add Cu. Nevertheless, Ni does increase the corrosion resistance of the magnet and can be added to account for 1 at % or less.

Among those additive elements M, Ti, V, Cr, Zr, Nb, Mo, Hf, Ta and W achieve the effect of forming a high melting deposition of a boride in the texture and checking the growth of crystal grains during the sintering process. However, those elements will form a deposition that has nothing to do with magnetism and will decrease the magnetization eventually, and therefore, are preferably added in 1 at % or less.

Among these elements, Zr behaves rather differently from the others. Specifically, if the amount of B added is small, Zr will not be deposited in the form of a Zr boride but will still check the grain growth anyway. That is why if 0.1 at % or less of Zr and 5.8 at % or less of B are added, the magnetization will not decrease. This is believed to be because Zr is an element that can produce a solid solution in the main phase according to the conditions.

Among those additive elements M, In, Sn, Pb and Bi will contribute to improving the physical properties of the grain boundary phase and increasing the coercivity of the magnet. However, if these elements were added excessively, then the magnetization of the magnet would decrease. That is why these elements are preferably added in 0.5 at % or less combined.

The impurities that could be contained in this type of magnet include O, C, N, H, Si, Ca, Mg, S and P. Among other things, the content of O (oxygen) has direct impact on the performance of the magnet. The interfacial film-like structure including Cu is believed to be an fcc compound, of which the composition is represented by R—Cu—O, and is said to contribute to increasing the coercivity. That is why from this point of view, it is preferred that a very small amount of oxygen be contained. However, oxygen is an element to be contained inevitably during the manufacturing process and its preferred amount is smaller than what should be contained inevitably during the process. That is why the magnetic properties should not be affected adversely even if oxygen is eliminated as much as possible to improve the performance. Specifically, to reduce the content of oxygen to less than 0.02 mass %, bulky anti-oxidation equipment should be required, which is not beneficial from an industrial point of view. Nevertheless, if the content of oxygen exceeded 0.8 mass %, then the sintering process might not get done sufficiently according to the composition of the present invention. Also, even if a sintered magnet could be obtained anyway, its performance should be too low to be an ideal one.

C, N and H contained preferably account for 0.1 mass % or less, 0.03 mass % or less, and 0.01 mass % or less, respectively. Si is not only contained in the Fe—B material alloy or Fe but also may come from a crucible or any other member of the furnace during the melting process. If a lot of Si were contained, then an Fe—Si alloy would be produced and the percentage of the main phase would decrease. For that reason, Si preferably accounts for 0.05 mass % or less.

Ca is used to reduce a rare-earth element, and therefore, is contained as an impurity in the rare-earth material but has nothing to do with the magnetic properties. Nevertheless, as Ca sometimes affects adversely corrosion behavior, the content of Ca is preferably 0.03 mass % or less. And S and P often come from the Fe material but have nothing to do with the magnetic properties, either. That is why their content is preferably 0.05 mass % or less.

The crystal grain size of a sintered magnet has impact on the coercivity. Meanwhile, the state of the grain boundary phase also has impact on the coercivity. That is why in the prior art, even if the crystal grain size is just reduced by a conventional technique, high coercivity cannot be achieved. The reason is as follows. Specifically, if the crystal grain size is reduced, the area of the crystal grain boundary will increase, so will the amount of the grain boundary phase to be included to produce coercivity. That is why if the size of the crystal grain size is just reduced while using the same composition, then the grain boundary phase will run short. In that case, the increase in coercivity due to the reduction in crystal grain size and the decrease in coercivity due to the shortage of the grain boundary phase will cancel each other. As a result, the effect that should have been achieved by reducing the crystal grain size has actually not been achieved fully so far.

According to the present invention, by defining the preferred ranges of R, Cu and Mn mole fractions, the grain boundary phase will never run short and the coercivity can be increased. In particular, even if the size of the crystal grains is reduced, there will never be any lack of the grain boundary phase.

The crystal grain size can be obtained by observing a cross section of the magnet through image processing. In this description, the "crystal grain size" is supposed to be represented by the diameter of a circle that has the same area as a crystal grain observed on the cross-sectional structure of the magnet. Such a diameter will be referred to herein as "equivalent circle diameter" (which is also called "Heywood diameter"). The finer the sintered structure, the more effective the composition of the present invention. For example, the combined area of portions of the main phase, of which the crystal grain sizes are represented by equivalent circle diameters of 8 μm or less, preferably accounts for at least 70% of the overall area of the main phase.

Furthermore, the effect of increasing the coercivity by reducing the crystal grain size is achieved more significantly if the combined area of portions of the main phase, of which the crystal grain sizes are represented by equivalent circle diameters of 5 μm or less, accounts for at least 80% of the overall area of the main phase. That is why the combined area of those portions preferably accounts for 80% or more of the entire main phase.

Meanwhile, crystal grains, of which the sizes exceed 12 μm, would have been produced due to an abnormal grain growth during the sintering process and the presence of such grains would decrease the coercivity. For that reason, the crystal grain size is preferably represented by an equivalent circle diameter of 12 μm or less. As used herein, the "area ratio" is the ratio of the combined area of those crystal grains to the overall area of the main phases, which does not include the grain boundary phases and the other phases.

The R-T-Cu—Mn—B based sintered magnet of the present invention may be produced by an ordinary manufacturing process that is generally used to make a conventional R-T-B based sintered magnet. And the magnet of the present invention is preferably made by a technique for getting the sintering process done without inducing the abnormal grain growth of the main phase crystal grains.

The manufacturing process to be described below is only an exemplary method of making the magnet of the present invention. That is why the present invention is in no way limited to the following process.

Material Alloy

The material alloy can be obtained by some ordinary process such as an ingot casting process, a strip casting process or a direct reduction process. Alternatively, a conventional two-alloy process can also be adopted. In that case, the processes of making those alloys to be combined and their compositions could be selected arbitrarily.

Among other things, the strip casting process can be used particularly effectively according to the present invention because the strip casting process would leave almost no αFe phase in the metal structure and can be used to make an alloy at a reduced cost without using any casting mold. Also, according to the present invention, to achieve a smaller particle size by pulverization in a preferred embodiment than in the prior art, the shortest R-rich phase interval is preferably 5 μm or less in the strip casting process. This is because if the R-rich phase interval exceeded 5 μm, an excessive load would be imposed on the fine pulverization process, in which the amounts of impurities contained would increase significantly.

To set the R-rich phase interval to be 5 μm or less in the strip casting process, the thickness of the cast flakes can be reduced by decreasing the melt feeding rate, the melt quenching rate may be increased by decreasing the surface roughness of the chill roller and increasing the degree of close contact between the melt and the chill roller, and/or the chill roller may be made of Cu or any other material with good thermal conductivity. The R-rich phase interval can be reduced to 5 μm or less by adopting either only one of these methods or two or more of them in combination.

Pulverization

As an example of a manufacturing process for producing the magnet of the present invention, a process in which pulverization is carried out in two stages (which will be referred to herein as "coarse pulverization" and "fine pulverization", respectively) will be described. However, according to the present invention, not just the manufacturing process to be described below but also any other manufacturing process may be adopted as well.

The material alloy is preferably coarsely pulverized by hydrogen decrepitation process, which is a process for producing very small cracks in the alloy by taking advantage of its volume expansion due to hydrogen occlusion and thereby pulverizing the alloy. In the alloy of the present invention, the cracks are produced due to a difference in the rate of occluding hydrogen between the main phase and the R-rich phase (i.e., a difference in their volume variation). That is why according to the hydrogen decrepitation process, the main phase is more likely to crack on the grain boundary.

In a hydrogen decrepitation process, normally the material alloy is exposed to pressurized hydrogen for a certain period of time at an ordinary temperature. Next, the alloy is heated to a raised temperature to release excessive hydrogen and then cooled. The coarse powder obtained by such a hydrogen decrepitation process has a huge number of internal cracks and a significantly increased specific surface. That is why the coarse powder is so active that a lot more oxygen would be absorbed when the powder is handled in the air. For that reason, the powder is preferably handled in an inert gas such as nitrogen or Ar gas. On top of that, as nitrification reaction could also occur at high temperatures, it is preferred that the coarse powder be handled in an Ar atmosphere if some increase in the manufacturing cost could be afforded.

As the fine pulverization process, dry pulverization may be carried out using a jet pulverizer. In that case, nitrogen gas is usually used as a pulverization gas for this type of magnet. According to the present invention, however, a rare gas such as Ar gas is preferably used to minimize the content of nitrogen in the composition of the magnet. If a He gas is used, then considerably great pulverization energy can be produced. As a result, a fine powder, which can be used effectively in the present invention, can be obtained easily. However, as the He gas is expensive, such a gas is preferably circulated with a compressor introduced into the circulation system. Hydrogen gas could also achieve a similar effect but is not preferred from an industrial point of view because the hydrogen gas might explode when mixed with oxygen gas.

The powder can be pulverized to a smaller particle size by performing a dry pulverization process using a gas that has great pulverization ability such as He gas, for example. Alternatively, the particle size can also be reduced by increasing the pressure or the temperature of the pulverization gas. Any of these methods can be adopted appropriately depending on the necessity.

Alternatively, a wet pulverization process may also be performed. Specifically, either a ball mill or an attritor may be used, for example. In that case, the pulverization medium and solvent and the atmosphere need to be selected so as to avoid absorbing oxygen, carbon and other impurities in more than predetermined amounts. On the other hand, with a beads mill for stirring up the given powder at high speeds using balls with a very small diameter, the powder can be pulverized finely in a short time and the influence of impurities can be minimized. That is why a beads mill is preferably used to obtain a fine powder for use in the present invention.

Furthermore, if the material alloy is pulverized in multiple stages (e.g., coarsely pulverized first by a dry process using a jet pulverizer and then finely pulverized by a wet process using a beads mill), then the alloy can be pulverized efficiently in a short time and the amounts of impurities contained in the fine powder can be minimized.

The solvent for use in the wet pulverization process is selected with its reactivity to the material powder, its ability to reduce oxidation, and its removability before the sintering process taken into consideration. For example, an organic solvent (e.g., a saturated hydrocarbon such as isoparaffin, among other things) is preferably used.

The particle size of the fine powder obtained by the fine pulverization process preferably satisfies D50<5 μm when measured by dry jet dispersion laser diffraction analysis.

Compaction

A compaction process to make the magnet of the present invention may be a known one. For example, the fine powder described above may be pressed and compacted with a die under a magnetic field. However, the size of the fine powder obtained in a preferred embodiment of the present invention is represented by a D50 of less than 3 μm when the particle size is measured by dry jet dispersion laser diffraction analysis. This particle size is smaller than a conventional normal powder particle size. That is why it is rather difficult to load the die with the fine powder and get crystals aligned with an external magnetic field applied. However, to minimize the amounts of oxygen and carbon absorbed, the use of a lubricant is preferably minimized. Optionally, a highly volatile lubricant, which can be removed either during the sintering process or even before that, may be selectively used from known ones.

If the use of the lubricant were minimized, however, it would be difficult to get the powder aligned with the magnetic field applied while a compaction process is being performed under the magnetic field. Particularly, as the fine powder has a small particle size according to the present invention, the moment received by each magnetic powder particle while the external magnetic field is applied thereto is so small that the chances of aligning the magnetic powder insufficiently further increase. However, as far as the performance of the magnet is concerned, the increase in coercivity caused by reducing the crystal grain size is more important than the decrease in remanence due to the disturbed orientation.

On the other hand, to increase the degree of magnetic alignment, it is preferred that the fine powder and a solvent be mixed together to make a slurry and then the slurry be compacted under a magnetic field. In that case, considering the volatility of the solvent, a hydrocarbon with a low molecular weight that can be vaporized almost completely in a vacuum at 250° C. or less may be selected for the next sintering process. Among other things, a saturated hydrocarbon such as isoparaffin is preferred. Also, the slurry may also be made by collecting the fine power directly in the solvent.

The pressure to be applied during the compaction process is not particularly limited. However, the pressure should be at least 9.8 MPa and preferably 19.6 MPa or more, and the upper limit thereof is 245 MPa at most, and preferably 196 MPa.

Sintering

The sintering process is supposed to be carried out within either a vacuum or an inert gas atmosphere, of which the pressure is lower than the atmospheric pressure and where the inert gas refers to Ar and/or He gas(es).

Such an inert gas atmosphere, of which the pressure is lower than the atmospheric pressure, is preferably maintained by evacuating the chamber with a vacuum pump and introducing the inert gas into the chamber. In that case, either evacuation or introduction of the inert gas may be performed intermittently. Or both the evacuation and the introduction of the inert gas may be carried out intermittently.

To remove sufficiently the solvent that has been used in the fine pulverization process and the compaction process, preferably it is not until a binder removal process is done that the sintering process is started. The binder removal process may be carried out by keeping the compact heated to a temperature of 300° C. or less for 30 minutes to 8 hours either within a vacuum or an inert gas atmosphere, of which the pressure is lower than the atmospheric pressure. The binder removal process could be performed independently of the sintering process but the binder removal process and the sintering process are preferably performed continuously to increase the efficiency of the process and reduce the oxidation as much as possible. The binder removal process is preferably carried out within an inert gas atmosphere, of which the pressure is lower than the atmospheric pressure, in order to get the binder removal process done as efficiently as possible. Optionally, to get the binder removal process done more efficiently, the heat treatment may be carried out within a hydrogen atmosphere.

In the sintering process, the compact is seen to release a gas while having its temperature raised. The gas released is mostly the hydrogen gas that has been introduced during the coarse pulverization process. It is not until the hydrogen gas is released that the liquid phase is produced. That is why to release the hydrogen gas completely, the compact is preferably kept heated to a temperature of 700° C. to 850° C. for 30 minutes to 4 hours.

The compact is supposed to be sintered at a temperature of 860° C. to 1,100° C. This temperature range is preferred for the following reasons. Specifically, if the sintering process temperature is lower than 860° C., the hydrogen gas would not be released sufficiently, the liquid phase would not be produced so much as to advance the sintering reaction smoothly, or in the worst-case scenario, the sintering reaction would not be produced at all according to the composition of the present invention. That is to say, a sintered density of 7.5 $Mg/m^3$ or more could not be obtained. On the other hand, if the sintering process temperature were higher than 1,100° C., the abnormal grain growth would advance easily and the resultant magnet would have decreased coercivity. A sintered structure, of which the size is represented by an equivalent circle diameter of 12 μm or less, refers to a sintered structure that is free from abnormal grain growth.

In the sintered structure of the magnet of the present invention, its crystal grain size is preferably represented by an equivalent circle diameter of 12 μm or less, although the crystal grain size is not particularly limited to this size. Also, the combined area of portions of the main phase, of which the sizes are represented by equivalent circle diameters of 8 μm or less, preferably accounts for 70% or more of the overall area of the main phase. To get such a sintered structure, the sintering temperature is preferably set to be 1,080° C. or less.

And to obtain a more preferred sintered structure, in which the combined area of portions of the main phase, of which the sizes are represented by equivalent circle diameters of 5 μm or less, accounts for 80% or more of the overall area of the main phase, the sintering process temperature is preferably 1,020° C. or less.

The sintering process temperature preferably falls within the preferred range for 2 to 16 hours. The reasons are as follows. Specifically, if the temperature stayed within that preferred range for less than two hours, the compact would not have its density increased sufficiently through the process, and therefore, the desired sintered density of 7.5 $Mg/m^3$ or more could not be achieved or the magnet would have decreased remanence. On the other hand, if the sintering temperature stayed within that range for more than 16 hours, the density and the magnetic properties would vary a little but chances of producing crystals with an equivalent circle diameter of more than 12 μm would increase. And if such crystals were produced, the coercivity would decrease. However, if the sintering process is performed at 1,000° C. or less, then the sintering process could be continued for an even longer time, e.g., 48 hours or less.

It should be noted, however, that in the sintering process, the sintering process temperature does not have to be maintained at a certain temperature falling within that preferred range for that preferred period of time. In other words, the sintering process temperature may be varied within that range. For example, the sintering process temperature could be maintained at 1,000° C. for first two hours and then maintained at 940° C. for the next four hours. Alternatively, the sintering process temperature may even be gradually lowered from 1,000° C. to 860° C. in eight hours, instead of being maintained at a particular temperature.

Heat Treatment

After the sintering process is finished, the sintered compact is once cooled to 300° C. or less. After that, the sintered compact is thermally treated within the range of 400° C. to its sintering process temperature to have its coercivity increased. This heat treatment may be either carried out continuously at the same temperature or performed in multiple steps with the temperature varied. Particularly, according to the present invention, by defining the amount of Cu added to fall within a predetermined range, the coercivity can be increased even more significantly by conducting this heat treatment process. For example, the heat treatment process may be carried out in the three steps of: keeping the sintered compact heated to 1,000° C. for an hour and cooling it rapidly; keeping the compact heated to 800° C. for an hour and cooling it rapidly; and keeping the compact heated to 500° C. for an hour and then cooling it rapidly. In some cases, the coercivity may increase by keeping the compact heated to the heat treatment temperature and then cooling it gradually. Since the magnetization does not usually vary during the heat treatment after the sintering process, appropriate conditions can be set to increase the coercivity according to the composition, size, or shape of the magnet.

Machining

The magnet of the present invention may be subjected to some ordinary type of machining such as cutting or grinding to obtain a desired shape or size.

Surface Treatment

The magnet of the present invention is preferably subjected to some kind of surface coating treatment for anti-corrosion purposes. Examples of preferred surface coating treatments include Ni plating, Sn plating, Zn plating, vapor deposition of an Al film or an Al-based alloy film, and resin coating.

Magnetization

The magnet of the present invention can be magnetized by an ordinary magnetization method (including application of a pulse magnetic field and application of a static magnetic field). In order to handle the magnet material as easily as possible, the magnet material is usually magnetized by such a method after the magnet material has been arranged to form a magnetic circuit. Naturally, however, the magnet can be magnetized by itself.

EXAMPLES

Example 1

An alloy with a target composition was obtained by mixing together Pr and Nd with a purity of 99.5 mass % or more, Tb and Dy with a purity of 99.9 mass % or more, electrolytic iron and low-carbon ferroboron as main ingredients, along with other target additive elements that were added as either pure metals or alloys with Fe, and the mixture was melted. The melt thus obtained was cast by strip casting process, thereby obtaining a plate alloy with a thickness of 0.3 to 0.4 mm. Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less. To this coarse powder, further added was 0.05 mass % of zinc stearate.

Next, the coarse powder was subjected to a dry pulverization process using a jet pulverizer (i.e., jet mill) within a nitrogen gas jet, thereby obtaining a finely pulverized powder with a particle size D50 of 4 to 5 μm. In this process step, as for Samples that should have their oxygen content reduced to 0.2 mass % or less, the concentration of oxygen in the pulverization gas is controlled to 50 ppm or less. This particle size D50 was obtained by dry jet dispersion laser diffraction analysis.

Then, the fine powder thus obtained was compacted under a magnetic field to obtain a compact. In this case, the magnetic field applied was a static magnetic field with a strength of approximately 0.8 MA/m and the pressure was 196 MPa. The magnetic field application direction and the pressuring direction were perpendicular to each other. As for samples that should have as low oxygen content as possible, until the pulverized alloy was loaded into a sintering furnace, the alloy was transported within a nitrogen atmosphere as much of the time interval as possible.

Then, the compact thus obtained was sintered at temperature(s) falling within the range of 1,020° C. to 1,080° C. for two hours within a vacuum. The sintering process temperature varied according to the composition. In any case, the compact was sintered at a lowest possible temperature selected as long as the sintered density would be 7.5 $Mg/m^3$.

The composition of the sintered body thus obtained was analyzed with an ICP. The results are converted into at % and shown in the following Table 1. On the other hand, the contents of oxygen, nitrogen and carbon shown in the following Table 1 were obtained as analyzed values by a gas analyzer and are shown in mass %. A hydrogen analysis was carried out on each of these samples by dissolution method. As a result, each sample had a hydrogen content of 10 to 30 ppm by mass.

TABLE 1

| | Magnet composition (at %) | | | | | | | | | | Impurities (mass %) | | |
|---|---|---|---|---|---|---|---|---|---|---|---|---|---|
| No. | Pr | Nd | Tb | Dy | Fe | Co | Cu | Mn | M | B | O | C | N |
| 1 | | 13.8 | | | bal. | | 0.08 | 0.01 | | 6.0 | 0.39 | 0.04 | 0.01 |
| 2 | | 13.8 | | | bal. | | 0.08 | 0.04 | | 6.0 | 0.40 | 0.03 | 0.01 |
| 3 | | 13.8 | | | bal. | | 0.08 | 0.06 | | 6.0 | 0.40 | 0.04 | 0.01 |
| 4 | | 13.8 | | | bal. | | 0.08 | 0.08 | | 5.9 | 0.39 | 0.04 | 0.01 |
| 5 | | 13.9 | | | bal. | | 0.08 | 0.15 | | 6.0 | 0.41 | 0.05 | 0.01 |
| 6 | | 13.8 | | | bal. | | 0.08 | 0.20 | | 6.0 | 0.39 | 0.04 | 0.01 |
| 7 | | 13.8 | | | bal. | | 0.11 | 0.04 | | 6.0 | 0.39 | 0.04 | 0.01 |
| 8 | | 13.8 | | | bal. | | 0.12 | 0.07 | | 5.9 | 0.40 | 0.04 | 0.01 |
| 9 | | 13.9 | | | bal. | 1.0 | 0.12 | 0.18 | | 6.0 | 0.40 | 0.06 | 0.01 |
| 10 | | 13.9 | | | bal. | 1.0 | 0.19 | 0.06 | | 6.0 | 0.40 | 0.04 | 0.01 |
| 11 | | 13.8 | | | bal. | | 0.20 | 0.14 | | 6.0 | 0.41 | 0.05 | 0.01 |
| 12 | | 13.8 | | | bal. | 2.0 | 0.28 | 0.05 | | 5.9 | 0.42 | 0.04 | 0.01 |
| 13 | | 13.7 | | | bal. | | 0.29 | 0.06 | | 5.9 | 0.40 | 0.03 | 0.01 |
| 14 | | 13.8 | | | bal. | 2.0 | 0.29 | 0.15 | | 6.0 | 0.40 | 0.03 | 0.01 |
| 15 | | 13.8 | | | bal. | | 0.29 | 0.14 | | 6.0 | 0.41 | 0.03 | 0.01 |
| 16 | | 13.8 | | | bal. | | 0.35 | 0.01 | | 6.0 | 0.41 | 0.03 | 0.01 |
| 17 | | 13.8 | | | bal. | | 0.35 | 0.04 | | 6.0 | 0.40 | 0.04 | 0.01 |
| 18 | | 13.8 | | | bal. | | 0.34 | 0.06 | | 6.0 | 0.39 | 0.05 | 0.01 |
| 19 | | 13.8 | | | bal. | | 0.35 | 0.13 | | 6.1 | 0.39 | 0.05 | 0.01 |
| 20 | | 13.9 | | | bal. | | 0.35 | 0.20 | | 6.1 | 0.41 | 0.05 | 0.01 |
| 21 | | 13.8 | | | bal. | | 0.35 | 0.25 | | 6.0 | 0.40 | 0.04 | 0.01 |
| 22 | | 13.8 | | | bal. | | 0.04 | 0.06 | | 6.0 | 0.38 | 0.04 | 0.01 |
| 23 | | 13.8 | | | bal. | | 0.40 | 0.06 | | 6.0 | 0.38 | 0.04 | 0.01 |
| 24 | | 13.8 | | | bal. | | 0.03 | 0.21 | | 6.0 | 0.38 | 0.04 | 0.01 |
| 25 | | 13.8 | | | bal. | | 0.38 | 0.22 | | 6.0 | 0.39 | 0.05 | 0.01 |
| 26 | 0.8 | 13.0 | | | bal. | | 0.10 | 0.06 | | 5.9 | 0.38 | 0.05 | 0.01 |
| 27 | 3.7 | 9.8 | | | bal. | | 0.10 | 0.06 | | 5.9 | 0.38 | 0.04 | 0.01 |
| 28 | 6.4 | 7.5 | | | bal. | | 0.10 | 0.06 | | 5.9 | 0.39 | 0.05 | 0.01 |
| 29 | | 13.0 | | 0.8 | bal. | | 0.10 | 0.06 | | 6.0 | 0.39 | 0.05 | 0.01 |
| 30 | | 12.4 | | 1.5 | bal. | 1.0 | 0.10 | 0.06 | Al: 0.5 | 6.0 | 0.38 | 0.04 | 0.01 |
| 31 | | 12.4 | | 1.5 | bal. | 1.0 | 0.10 | 0.06 | Ga: 0.5 | 5.7 | 0.38 | 0.04 | 0.01 |
| 32 | | 12.4 | | 1.5 | bal. | 1.0 | 0.10 | 0.06 | Al: 0.5 + Ga: 0.1 | 5.7 | 0.40 | 0.05 | 0.01 |
| 33 | | 12.4 | | 1.5 | bal. | 1.0 | 0.10 | 0.06 | Ga: 0.1 + Zr: 0.05 | 5.7 | 0.38 | 0.04 | 0.01 |
| 34 | | 12.4 | | 1.5 | bal. | 1.0 | 0.10 | 0.06 | Al: 0.8 + Nb: 0.2 | 6.1 | 0.38 | 0.05 | 0.01 |
| 35 | | 10.7 | | 3.0 | bal. | 1.0 | 0.10 | 0.06 | Al: 0.5 | 6.0 | 0.39 | 0.04 | 0.01 |
| 36 | 2.6 | 9.0 | 1.2 | | bal. | 2.0 | 0.10 | 0.06 | | 6.0 | 0.39 | 0.04 | 0.01 |
| 37 | | 12.2 | | 1.7 | bal. | 5.0 | 0.10 | 0.06 | Al: 0.5 + Mo: 1.0 | 6.3 | 0.38 | 0.05 | 0.01 |
| 38 | | 12.2 | | 1.7 | bal. | 5.0 | 0.10 | 0.06 | Al: 1.0 + Mo: 1.0 | 6.5 | 0.38 | 0.05 | 0.01 |
| 39 | | 12.0 | | | bal. | | 0.12 | 0.06 | | 5.9 | 0.13 | 0.06 | 0.02 |
| 40 | | 15.0 | | | bal. | | 0.12 | 0.06 | | 5.9 | 0.38 | 0.04 | 0.01 |
| 41 | | 13.8 | | | bal. | | 0.12 | 0.06 | Al: 0.5 + Ga: 0.1 | 5.5 | 0.37 | 0.05 | 0.01 |
| 42 | | 13.8 | | | bal. | | 0.12 | 0.06 | | 6.5 | 0.37 | 0.05 | 0.01 |
| 43 | | 13.0 | | | bal. | 2.0 | 0.10 | 0.06 | Al: 0.5 | 6.0 | 0.14 | 0.07 | 0.02 |
| 44 | | 11.6 | | 1.3 | bal. | 2.0 | 0.10 | 0.06 | Al: 0.5 | 6.0 | 0.15 | 0.06 | 0.02 |
| 45 | | 11.7 | | | bal. | | 0.12 | 0.06 | | 5.9 | 0.14 | 0.06 | 0.01 |
| 46 | | 15.4 | | | bal. | | 0.12 | 0.06 | | 5.9 | 0.39 | 0.04 | 0.01 |
| 47 | | 13.6 | | | bal. | | 0.12 | 0.06 | Al: 0.5 + Ga: 0.1 | 5.3 | 0.40 | 0.05 | 0.01 |
| 48 | | 13.7 | | | bal. | | 0.12 | 0.06 | | 6.6 | 0.40 | 0.04 | 0.01 |
| 49 | | 12.0 | | | bal. | 2.0 | 0.10 | 0.06 | Al: 0.5 | 6.0 | 0.18 | 0.07 | 0.02 |
| 50 | | 13.7 | | 1.3 | bal. | 2.0 | 0.10 | 0.06 | Al: 0.5 | 6.0 | 0.36 | 0.02 | 0.02 |

Besides hydrogen and the other elements shown in Table 1, Si, Ca, Cr, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures. No matter how many times the heat treatment was carried out, the heat treatment was conducted at a temperature of 480° C. to 600° C. for the last time. Furthermore, if the heat treatment was carried out two or more times, the heat treatment was carried out with the temperatures decreased sequentially and the processing temperature for the first heat treatment process was selected within the range of 750° C. to the sintering process temperature. As for the magnetic properties, among those samples with various compositions that had been thermally treated under multiple different conditions, only one of the samples that exhibited the highest coercivity $H_{cJ}$ at room temperature was analyzed.

Then, those samples were machined and then had their magnetic properties (i.e., the remanence $B_r$ and coercivity $H_{cJ}$) measured at room temperature by a B—H tracer. Samples that had coercivity $H_{cJ}$ of more than 1600 kA/m had only their coercivity measured by a pulse excited magnetometer (model TPM produced by Toei Industry Co., Ltd). It should be noted that the remanence value of a sample reflects the magnitude of magnetization of the sample.

Also, a cross-sectional structure of the magnet was observed through an optical microscope and the crystal grain size of its main phase was estimated by an equivalent circle diameter through image processing. The results are shown in the following Table 2:

TABLE 2

| | Crystal grain size area ratio (%) | | Magnetic properties | | |
|---|---|---|---|---|---|
| | | | $B_r$ | $H_{cJ}$ | $(BH)_{max}$ |
| No. | ≦8 μm | >12 μm | (T) | (kA/m) | (kJ/m³) |
| 1 | 82 | 0 | 1.390 | 745 | 370 |
| 2 | 84 | 0 | 1.389 | 843 | 372 |
| 3 | 84 | 0 | 1.388 | 851 | 370 |
| 4 | 85 | 0 | 1.389 | 839 | 373 |
| 5 | 84 | 0 | 1.388 | 824 | 371 |
| 6 | 85 | 0 | 1.388 | 764 | 369 |
| 7 | 85 | 0 | 1.388 | 870 | 370 |
| 8 | 83 | 0 | 1.388 | 872 | 371 |
| 9 | 86 | 0 | 1.386 | 868 | 369 |
| 10 | 84 | 0 | 1.387 | 875 | 373 |
| 11 | 85 | 0 | 1.388 | 871 | 374 |
| 12 | 84 | 0 | 1.387 | 842 | 374 |
| 13 | 82 | 0 | 1.387 | 846 | 373 |
| 14 | 85 | 0 | 1.386 | 842 | 372 |
| 15 | 83 | 0 | 1.386 | 850 | 371 |
| 16 | 84 | 0 | 1.355 | 785 | 350 |
| 17 | 82 | 0 | 1.384 | 835 | 372 |
| 18 | 81 | 0 | 1.385 | 833 | 370 |
| 19 | 83 | 0 | 1.385 | 828 | 371 |
| 20 | 84 | 0 | 1.381 | 776 | 369 |
| 21 | 82 | 0 | 1.367 | 724 | 358 |
| 22 | 82 | 0 | 1.388 | 685 | 355 |
| 23 | 83 | 0 | 1.352 | 845 | 349 |
| 24 | 82 | 0 | 1.371 | 612 | 324 |
| 25 | 83 | 0 | 1.368 | 711 | 362 |

TABLE 2-continued

| | Crystal grain size area ratio (%) | | Magnetic properties | | |
|---|---|---|---|---|---|
| | | | $B_r$ | $H_{cJ}$ | $(BH)_{max}$ |
| No. | ≦8 μm | >12 μm | (T) | (kA/m) | (kJ/m³) |
| 26 | 83 | 0 | 1.387 | 871 | 372 |
| 27 | 84 | 0 | 1.385 | 878 | 371 |
| 28 | 79 | 0 | 1.386 | 881 | 372 |
| 29 | 82 | 0 | 1.328 | 1195 | 339 |
| 30 | 83 | 0 | 1.303 | 1482 | 329 |
| 31 | 83 | 0 | 1.310 | 1469 | 332 |
| 32 | 84 | 0 | 1.307 | 1510 | 331 |
| 33 | 82 | 0 | 1.307 | 1498 | 331 |
| 34 | 83 | 0 | 1.285 | 1520 | 320 |
| 35 | 81 | 0 | 1.208 | 2045 | 284 |
| 36 | 82 | 0 | 1.330 | 1845 | 344 |
| 37 | 86 | 0 | 1.262 | 1782 | 310 |
| 38 | 86 | 0 | 1.260 | 1804 | 308 |
| 39 | 83 | 0 | 1.472 | 824 | 421 |
| 40 | 70 | 0 | 1.336 | 875 | 346 |
| 41 | 82 | 0 | 1.398 | 855 | 381 |
| 42 | 80 | 0 | 1.377 | 877 | 368 |
| 43 | 72 | 0 | 1.438 | 895 | 402 |
| 44 | 74 | 0 | 1.374 | 1455 | 368 |
| 45 | 75 | 0 | 1.402 | 574 | 322 |
| 46 | 71 | 0 | 1.294 | 884 | 325 |
| 47 | 83 | 0 | 1.380 | 671 | 331 |
| 48 | 84 | 0 | 1.365 | 822 | 362 |
| 49 | 87 | 0 | 1.462 | 871 | 415 |
| 50 | 82 | 0 | 1.255 | 1435 | 305 |

As can be seen from Tables 1 and 2, Samples Nos. 1 and 6 had lower coercivity $H_{cJ}$ than Samples Nos. 2 to 5 having the same composition except the Mn mole fraction. The same can be said about the relation between Samples Nos. 16, and 21 and Samples Nos. 17 to 19. Also, Sample No. 22 had a low Cu mole fraction, and therefore, exhibited lower coercivity $H_{cJ}$ than Sample No. 3, for example. The same result was obtained from Samples Nos. 24 and 6, too. It can also be seen that Samples Nos. 23 and 25 had an excessive Cu mole fraction but exhibited lower remanence $B_r$ than Samples Nos. 18 and 20, respectively.

To show clearly how the amount of Mn added affects the magnetic properties, FIG. 1 shows the magnetic properties of Samples Nos. 1 to 6 and Nos. 16 to 21. It can be seen from FIG. 1 that if the amount of Mn added falls within the range of 0.04 at % to 0.20 at %, the coercivity $H_{cJ}$ and the remanence $B_r$ are both high irrespective of the Cu mole fraction. It can also be seen from FIG. 1 that particularly beneficial effects are achieved if the amount of Mn added is equal to or smaller than 0.15 at %.

Figure 2:
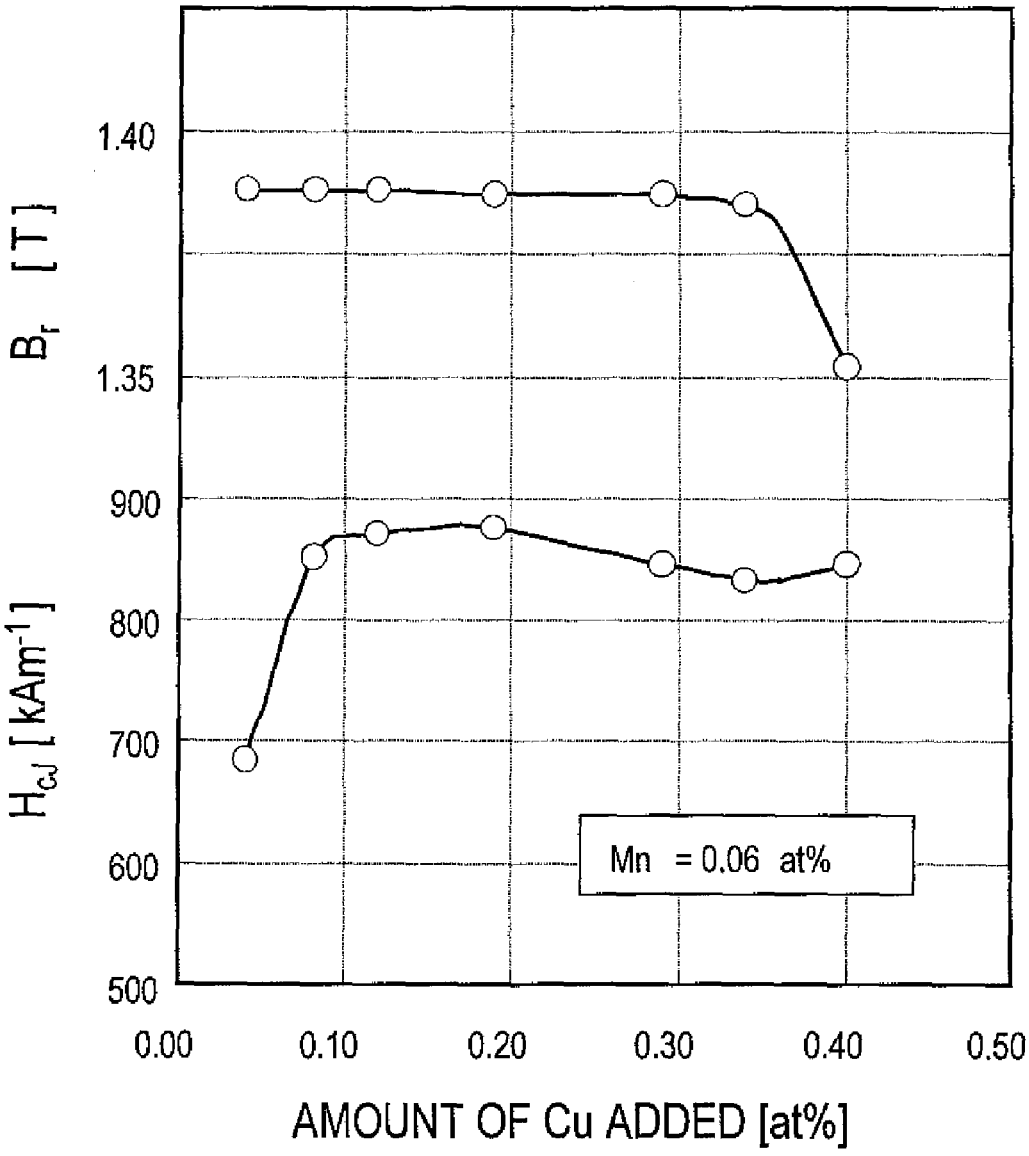
FIG. 2 shows how the magnetic properties of an Nd—Fe—(Co)—Cu—Mn—B based sintered magnet vary with the amount of Cu added.

FIG. 2 shows the magnetic properties of Samples Nos. 3, 8, 10, 13, 18, 22 and 23. The graph of FIG. 2 shows how the magnetic properties depend on the amount of Cu added at a Mn mole fraction of 0.06 at %. It should be noted that Samples Nos. 10 and 13 include Co in their composition. As can be seen from FIG. 2, if Cu is equal to or greater than 0.08 at %, the coercivity $H_{cJ}$ is high. On the other hand, if Cu is equal to or smaller than 0.35 at %, the remanence $B_r$ is high. That is to say, good magnetic properties are realized by adding 0.08 to 0.35 at % of Cu.

Sample No. 45 had an R mole fraction of 11.7 at % and exhibited low coercivity $H_{cJ}$. On the other hand, Sample No. 46 had an R mole fraction of 15.4 at % and exhibited low remanence $B_r$.

Sample No. 47 had a B mole fraction of 5.3 at % and exhibited lower coercivity $H_{cJ}$ and lower remanence $B_r$ than Sample No. 41 having a similar composition. And Sample No. 48 had a B mole fraction of 6.6 at % and exhibited lower remanence $B_r$ than Sample No. 42 having a similar composition.

Example 2

A melt of a material alloy was obtained by mixing together Pr and Nd with a purity of 99.5 mass % or more, electrolytic iron and low-carbon ferroboron as main ingredients, along with additive elements (Co and/or M) added as either pure metals or alloys with Fe, and then melting the mixture. The melt thus obtained was cast by strip casting process, thereby obtaining a plate alloy with a thickness of 0.1 to 0.3 mm.

8 hours within a vacuum. The sintering process temperature and process time vary according to the composition. In any case, the compact was sintered at a lowest possible temperature selected as long as the sintered density would be 7.5 $Mg/m^3$.

The composition of the sintered body thus obtained was analyzed. The results are shown in the following Table 3, in which every data shown had been converted into at %. The analysis was carried out using an ICP. On the other hand, the contents of oxygen, nitrogen and carbon were obtained using a gas analyzer and are shown in mass %. According to the results obtained by hydrogen analysis by dissolution method, each of these samples had a hydrogen content of 10 to 30 ppm by mass.

TABLE 3

| | Magnet composition (at %) | | | | | | | | Impurities (mass %) | | |
|---|---|---|---|---|---|---|---|---|---|---|---|
| No. | Pr | Nd | Fe | Co | Cu | Mn | M | B | O | C | N |
| 51 | 3.5 | 11.0 | bal. | 2.0 | 0.18 | 0.10 | Al: 0.5 | 6.0 | 0.48 | 0.12 | 0.01 |
| 52 | 3.5 | 11.0 | bal. | 2.0 | 0.18 | 0.10 | Al: 0.5 | 6.0 | 0.51 | 0.12 | 0.01 |
| 53 | 3.5 | 11.0 | bal. | 2.0 | 0.18 | 0.10 | Al: 0.5 | 6.0 | 0.49 | 0.11 | 0.01 |
| 54 | 3.5 | 11.0 | bal. | 2.0 | 0.18 | 0.10 | Al: 0.5 | 6.0 | 0.48 | 0.12 | 0.01 |
| 55 | 3.5 | 11.0 | bal. | 2.0 | 0.18 | 0.10 | Al: 0.5 | 6.0 | 0.49 | 0.12 | 0.01 |
| 56 | 3.5 | 11.0 | bal. | 2.0 | 0.08 | 0.10 | Al: 0.5 + Ni: 0.1 | 6.0 | 0.51 | 0.13 | 0.01 |
| 57 | 3.5 | 11.0 | bal. | 2.0 | 0.08 | 0.10 | Al: 0.5 + Zn: 0.1 | 6.0 | 0.50 | 0.13 | 0.01 |
| 58 | 3.5 | 11.0 | bal. | 2.0 | 0.08 | 0.10 | Al: 0.5 + Ag: 0.1 | 6.0 | 0.50 | 0.14 | 0.01 |
| 59 | 3.5 | 11.0 | bal. | 2.0 | 0.08 | 0.10 | Al: 0.5 + Sn: 0.1 | 6.0 | 0.51 | 0.14 | 0.01 |
| 60 | 3.5 | 11.0 | bal. | 2.0 | 0.08 | 0.10 | Al: 0.5 + Ag: 0.2 | 6.0 | 0.52 | 0.14 | 0.01 |
| 61 | 3.5 | 11.0 | bal. | 2.0 | 0.08 | 0.10 | Al: 0.2 | 6.0 | 0.51 | 0.13 | 0.01 |
| 62 | 3.5 | 11.0 | bal. | 2.0 | 0.12 | 0.10 | Al: 0.5 + In: 0.05 | 6.0 | 0.52 | 0.14 | 0.01 |
| 63 | 3.5 | 11.0 | bal. | 2.0 | 0.12 | 0.10 | Al: 0.5 + Au: 0.05 | 6.0 | 0.54 | 0.13 | 0.01 |
| 64 | 3.5 | 11.0 | bal. | 2.0 | 0.12 | 0.10 | Al: 0.5 + Pb: 0.05 | 6.0 | 0.54 | 0.14 | 0.01 |
| 65 | 3.5 | 11.0 | bal. | 2.0 | 0.12 | 0.10 | Al: 0.5 + Bi: 0.05 | 6.0 | 0.52 | 0.13 | 0.01 |

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill within a nitrogen gas jet, of which the oxygen concentration was controlled to 50 ppm or less, thereby obtaining an intermediate finely pulverized powder with a particle size D50 of 8 to 10 μm. Next, the intermediate finely pulverized powder was further pulverized finely using a beads mill to obtain a fine powder having a particle size D50 of 3.7 μm or less and an oxygen content of 0.2 mass % or less. This particle size was obtained by drying the slurry that had been produced by the beads mill and then subjecting it to a dry jet dispersion laser diffraction analysis.

The beads mill pulverization was carried out for a predetermined period of time using beads with a diameter of 0.8 mm and n-paraffin as a solvent.

Then, the fine powder thus obtained as slurry was compacted under a magnetic field to obtain a compact. In this case, the magnetic field applied was a static magnetic field with a strength of approximately 0.8 MA/m and the pressure was 196 MPa. The magnetic field application direction and the pressuring direction were perpendicular to each other. Until the pulverized alloy was loaded into a sintering furnace, the alloy was transported within a nitrogen atmosphere as much of the time interval as possible.

Then, the compact thus obtained was sintered at temperature(s) falling within the range of 940° C. to 1,120° C. for 2 to Also, besides hydrogen and the other elements shown in Table 3, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures. No matter how many times the heat treatment was carried out, the heat treatment was conducted at a temperature of 480° C. to 600° C. for the last time. Furthermore, if the heat treatment was carried out two or more times, the heat treatment was carried out with the temperatures decreased sequentially and the processing temperature for the first heat treatment process was selected within the range of 750° C. to the sintering process temperature.

The magnetic properties and the textures of the sintered bodies were evaluated by the same techniques as the ones adopted in Example 1. The following Table 4 summarizes the crystal grain size distribution of the magnet, the area ratio of crystals with equivalent circle diameters of 5 μm or less, the area ratio of crystals with equivalent circle diameters of more than 12 μm, the pulverization process time, the fine powder particle size D50, the sintering process temperature, the sintering process time, and the magnetic properties of the samples shown in Table 3.

TABLE 4

| | Fine powder | | | Sintering condition | | Crystal grain size area ratio (%) | | Magnetic properties | | |
|---|---|---|---|---|---|---|---|---|---|---|
| No. | Primary D50 (μm) | Secondary pulverization | D50 (μm) | Temperature (° C.) | Kept sintered for | ≦5 μm | >12 μm | $B_r$ (T) | $H_{cJ}$ (kA/m) | $(BH)_{max}$ (kJ/m$^3$) |
| 51 | 9.6 | 5 minutes | 3.5 | 1000 | 6 hrs. | 93 | 0 | 1.368 | 892 | 364 |
| 52 | 9.6 | 5 minutes | 3.5 | 1020 | 4 hrs. | 85 | 0 | 1.366 | 896 | 363 |
| 53 | 9.6 | 5 minutes | 3.5 | 1040 | 4 hrs. | 76 | 0 | 1.368 | 843 | 362 |
| 54 | 9.6 | 5 minutes | 3.5 | 1080 | 2 hrs. | 62 | 8 | 1.370 | 812 | 360 |
| 55 | 9.6 | 5 minutes | 3.5 | 1120 | 2 hrs. | 38 | 21 | 1.370 | 740 | 355 |
| 56 | 9.4 | 5 minutes | 3.6 | 960 | 6 hrs. | 92 | 0 | 1.368 | 844 | 364 |
| 57 | 9.2 | 5 minutes | 3.6 | 940 | 8 hrs. | 94 | 0 | 1.368 | 862 | 364 |
| 58 | 9.2 | 5 minutes | 3.7 | 960 | 4 hrs. | 91 | 0 | 1.368 | 883 | 363 |
| 59 | 9.3 | 5 minutes | 3.5 | 1000 | 4 hrs. | 92 | 0 | 1.369 | 881 | 364 |
| 60 | 9.4 | 5 minutes | 3.6 | 1000 | 4 hrs. | 92 | 0 | 1.367 | 892 | 363 |
| 61 | 8.9 | 5 minutes | 3.6 | 1000 | 4 hrs. | 91 | 0 | 1.367 | 887 | 363 |
| 62 | 8.8 | 5 minutes | 3.5 | 1000 | 6 hrs. | 89 | 0 | 1.368 | 864 | 363 |
| 63 | 8.9 | 5 minutes | 3.6 | 980 | 6 hrs. | 89 | 0 | 1.369 | 872 | 364 |
| 64 | 9.1 | 5 minutes | 3.4 | 980 | 6 hrs. | 88 | 0 | 1.365 | 862 | 363 |
| 65 | 9.0 | 5 minutes | 3.5 | 980 | 6 hrs. | 90 | 0 | 1.365 | 860 | 362 |

In Table 4, the results for Samples Nos. 51 to 55 were obtained by subjecting the same fine powder and the same compact to a sintering process at different process temperatures and for different lengths of time. Specifically, in Samples Nos. 53 to 55, the area ratio of main phase crystal grains with crystal grain sizes (equivalent circle diameters) of 5 μm or less was less than 80% of the entire main phase and their coercivity $H_{cJ}$ was somewhat lower than those of Samples Nos. 51 and 52. In Samples Nos. 54 and 55, on the other hand, some grains with crystal grain sizes (equivalent circle diameters) of more than 12 μm were observed. These are the results of an abnormal grain growth that occurred during the sintering process. And it can be seen that the coercivity $H_{cJ}$ decreased as a result.

Example 3

A melt of a material alloy was obtained by mixing together Pr and Nd with a purity of 99.5 mass % or more, Dy with a purity of 99.9 mass % or more, electrolytic iron and pure boron as main ingredients, along with (Co and/or M) added as either pure metals or alloys with Fe, and then melting the mixture. The melt thus obtained was cast by strip casting process, thereby obtaining a plate alloy with a thickness of 0.1 to 0.3 mm.

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill with a rotary classifier within an Ar gas jet. In this process step, the rotational frequency of the classifier was varied and the pressure of the pulverization gas was set to be relatively high, thereby obtaining a fine powder with a particle size D50 of 3.8 μm or less and an oxygen content of 0.2 mass % or less. This particle size was obtained by dry jet dispersion laser diffraction analysis.

Then, the fine powder thus obtained was compacted under a magnetic field within a nitrogen atmosphere to obtain a compact. In this case, the magnetic field applied was a static magnetic field with a strength of approximately 1.2 MA/m and the pressure was 147 MPa. The magnetic field application direction and the pressuring direction were perpendicular to each other. Until the pulverized alloy was loaded into a sintering furnace, the alloy was transported within a nitrogen atmosphere as much of the time interval as possible.

Next, this compact was sintered within a vacuum either at 980° C. for six hours or at 1,000° C. for four hours.

The composition of the sintered body thus obtained was analyzed with an ICP. The results are converted into at % and shown in the following Table 5. On the other hand, the contents of oxygen, nitrogen and carbon shown in the following Table 5 were obtained as analyzed values by a gas analyzer and are shown in mass %. A hydrogen analysis was carried out on each of these samples by dissolution method. As a result, each sample had a hydrogen content of 10 to 30 ppm by mass.

TABLE 5

| | Magnet composition (at %) | | | | | | | | | Impurities (mass %) | | |
|---|---|---|---|---|---|---|---|---|---|---|---|---|
| No. | Pr | Nd | Dy | Fe | Co | Cu | Mn | M | B | O | C | N |
| 66 | 3.0 | 8.5 | 1.0 | bal. | 4.0 | 0.24 | 0.15 | Al: 0.5 | 6.0 | 0.12 | 0.05 | 0.01 |
| 67 | 3.0 | 8.5 | 1.0 | bal. | 4.0 | 0.24 | 0.15 | Al: 0.5 + Ti: 0.1 | 6.2 | 0.13 | 0.04 | 0.01 |
| 68 | 3.0 | 8.5 | 1.0 | bal. | 4.0 | 0.24 | 0.15 | Al: 0.5 + V: 0.1 | 6.2 | 0.13 | 0.05 | 0.01 |
| 69 | 3.0 | 8.5 | 1.0 | bal. | 4.0 | 0.24 | 0.15 | Al: 0.5 + Cr: 0.2 | 6.1 | 0.13 | 0.06 | 0.01 |
| 70 | 3.0 | 8.5 | 1.0 | bal. | 4.0 | 0.24 | 0.15 | Al: 0.5 + Zr: 0.2 | 6.3 | 0.11 | 0.05 | 0.01 |
| 71 | 3.0 | 8.5 | 1.0 | bal. | 4.0 | 0.24 | 0.15 | Al: 0.5 + Nb: 0.2 | 6.5 | 0.11 | 0.05 | 0.01 |
| 72 | 3.0 | 8.5 | 1.0 | bal. | 4.0 | 0.24 | 0.15 | Al: 0.5 + Hf: 0.1 | 6.2 | 0.11 | 0.06 | 0.01 |
| 73 | 3.0 | 8.5 | 1.0 | bal. | 4.0 | 0.24 | 0.15 | Al: 0.5 + Ta: 0.1 | 6.2 | 0.12 | 0.05 | 0.01 |
| 74 | 3.0 | 8.5 | 1.0 | bal. | 4.0 | 0.24 | 0.15 | Al: 0.5 + W: 0.1 | 6.2 | 0.12 | 0.05 | 0.01 |
| 75 | 3.0 | 8.5 | 1.0 | bal. | 4.0 | 0.24 | 0.15 | Al: 0.5 + Zr: 0.05 | 6.0 | 0.11 | 0.06 | 0.01 |
| 76 | 3.0 | 8.5 | 1.0 | bal. | 4.0 | 0.24 | 0.15 | Ga: 0.1 + Zr: 0.05 | 5.8 | 0.12 | 0.05 | 0.01 |
| 77 | 3.0 | 8.5 | 1.0 | bal. | 4.0 | 0.24 | 0.15 | Ga: 0.1 + Zr: 0.05 | 5.6 | 0.12 | 0.05 | 0.01 |

TABLE 5-continued

| | Magnet composition (at %) | | | | | | | | | Impurities (mass %) | | |
|---|---|---|---|---|---|---|---|---|---|---|---|---|
| No. | Pr | Nd | Dy | Fe | Co | Cu | Mn | M | B | O | C | N |
| 78 | 3.0 | 8.5 | 1.0 | bal. | 4.0 | 0.24 | 0.15 | Ga: 0.1 + Zr: 0.05 | 5.5 | 0.11 | 0.04 | 0.01 |
| 79 | 3.0 | 8.5 | 1.0 | bal. | 4.0 | 0.24 | 0.15 | Ga: 0.1 + Zr: 0.1 | 5.6 | 0.12 | 0.04 | 0.01 |
| 80 | 3.0 | 8.5 | 1.0 | bal. | 4.0 | 0.24 | 0.15 | Ga: 0.1 + Zr: 0.1 | 5.6 | 0.13 | 0.04 | 0.01 |

Also, besides hydrogen and the other elements shown in Table 5, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures.

The magnetic properties and the textures of the sintered bodies were evaluated by the same techniques as the ones adopted in Example 1. The following Table 6 summarizes the crystal grain size distribution of the magnet, the area ratio of crystals with equivalent circle diameters of 5 μm or less, the area ratio of crystals with equivalent circle diameters of more than 12 μm, the fine powder particle size D50, the sintering process temperature, the sintering process time, and the magnetic properties of the samples shown in Table 5. No matter how many times the heat treatment was carried out, the heat treatment was conducted at a temperature of 480° C. to 600° C. for the last time. Furthermore, if the heat treatment was carried out two or more times, the heat treatment was carried out with the temperatures decreased sequentially and the processing temperature for the first heat treatment process was selected within the range of 750° C. to the sintering process temperature.

In this specific example, the effects achieved by adding various additive elements M including Al, Ti, V, Cr, Zr, Nb, Hf, Ta, W and Ga have been described. Among these elements, only Ti, V, Cr, Zr, Nb, Hf, Ta and W were added to Samples Nos. 67 to 75. Each of these samples had greater coercivity than Sample No. 66 to which only Al was added.

Example 4

A melt of a material alloy was obtained by mixing together Pr and Nd with a purity of 99.5 mass % or more, Tb and Dy with a purity of 99.9 mass % or more, electrolytic iron and pure boron as main ingredients, along with (Co and/or M) added as either pure metals or alloys with Fe, and then melting the mixture. The melt thus obtained was cast by strip casting process, thereby obtaining a plate alloy with a thickness of 0.1 to 0.3 mm.

Next, that alloy was decrepitated with hydrogen in a pressurized hydrogen atmosphere, heated to 600° C. within a vacuum, and then cooled. Thereafter, the alloy was classified with a sieve to obtain a coarse alloy powder with particle sizes of 425 μm or less.

Subsequently, the coarse alloy powder was subjected to a dry pulverization process using a jet mill within an He gas jet, thereby obtaining a fine powder having a particle size D50 of 3.5 μm or less and an oxygen content of 0.2 mass % or less. This particle size was obtained by dry jet dispersion laser diffraction analysis.

Then, the fine powder thus obtained was put into a solvent and compacted as a slurry under a magnetic field to obtain a compact. In this case, the magnetic field applied was a static magnetic field with a strength of approximately 1.2 MA/m and the pressure was 147 MPa. The magnetic field application direction and the pressuring direction were perpendicular to each other. Until the pulverized alloy was loaded into a sintering furnace, the alloy was transported within a nitrogen atmosphere as much of the time interval as possible. As the solvent, isoparaffin was used.

Next, this compact was sintered within a vacuum at 1,000° C. for four hours. The composition of the sintered body thus obtained was analyzed with an ICP. The results are converted into at % and shown in the following Table 7. On the other

TABLE 6

| | | Sintering condition | | Crystal grain size area ratio (%) | | Magnetic properties | | |
|---|---|---|---|---|---|---|---|---|
| No. | Fine powder D50 (μm) | Temperature (° C.) | Kept sintered for | ≦5 μm | >12 μm | $B_r$ (T) | $H_{cJ}$ (kA/m) | $(BH)_{max}$ (kJ/m$^3$) |
| 66 | 3.8 | 980 | 6 hrs. | 90 | 0 | 1.384 | 1284 | 373 |
| 67 | 3.3 | 980 | 6 hrs. | 93 | 0 | 1.368 | 1352 | 364 |
| 68 | 3.4 | 980 | 6 hrs. | 94 | 0 | 1.366 | 1360 | 362 |
| 69 | 3.3 | 980 | 6 hrs. | 93 | 0 | 1.374 | 1384 | 367 |
| 70 | 3.4 | 980 | 6 hrs. | 93 | 0 | 1.359 | 1364 | 360 |
| 71 | 3.2 | 980 | 6 hrs. | 92 | 0 | 1.345 | 1310 | 350 |
| 72 | 3.2 | 980 | 6 hrs. | 91 | 0 | 1.367 | 1296 | 361 |
| 73 | 3.3 | 980 | 6 hrs. | 92 | 0 | 1.366 | 1315 | 359 |
| 74 | 3.3 | 980 | 6 hrs. | 92 | 0 | 1.367 | 1302 | 363 |
| 75 | 3.4 | 1000 | 4 hrs. | 94 | 0 | 1.383 | 1332 | 371 |
| 76 | 3.4 | 1000 | 4 hrs. | 95 | 0 | 1.390 | 1364 | 375 |
| 77 | 3.4 | 1000 | 4 hrs. | 94 | 0 | 1.398 | 1349 | 380 |
| 78 | 3.5 | 1000 | 4 hrs. | 92 | 0 | 1.397 | 1331 | 379 |
| 79 | 3.4 | 1000 | 4 hrs. | 92 | 0 | 1.397 | 1335 | 379 |
| 80 | 3.5 | 1000 | 4 hrs. | 93 | 0 | 1.398 | 1351 | 381 |

hand, the contents of oxygen, nitrogen and carbon shown in the following Table 7 were obtained as analyzed values by a gas analyzer and are shown in mass %. A hydrogen analysis was carried out on each of these samples by dissolution method. As a result, each sample had a hydrogen content of 10 to 30 ppm by mass.

TABLE 7

| | Magnet composition (at %) | | | | | | | | | | Impurities (mass %) | | |
|---|---|---|---|---|---|---|---|---|---|---|---|---|---|
| No. | Pr | Nd | Tb | Dy | Fe | Co | Cu | Mn | M | B | O | C | N |
| 81 | 2.8 | 7.6 | | 1.8 | bal. | 1.0 | 0.10 | 0.18 | Al: 0.4 + Ga: 0.08 | 5.8 | 0.10 | 0.07 | 0.01 |
| 82 | 2.8 | 7.6 | | 1.8 | bal. | 1.0 | 0.20 | 0.18 | Al: 0.4 + Ga: 0.08 | 5.8 | 0.09 | 0.07 | 0.01 |
| 83 | 2.8 | 7.6 | | 1.8 | bal. | 1.0 | 0.30 | 0.18 | Al: 0.4 + Ga: 0.08 | 5.8 | 0.10 | 0.07 | 0.01 |
| 84 | 2.8 | 7.6 | | 1.8 | bal. | 1.0 | 0.35 | 0.18 | Al: 0.4 + Ga: 0.08 | 5.8 | 0.10 | 0.08 | 0.01 |
| 85 | 2.8 | 7.6 | | 1.8 | bal. | 1.0 | 0.40 | 0.18 | Al: 0.4 + Ga: 0.08 | 5.8 | 0.09 | 0.07 | 0.01 |
| 86 | 3.0 | 7.9 | 1.2 | | bal. | 1.0 | 0.08 | 0.19 | Al: 0.4 + Ga: 0.08 | 5.8 | 0.09 | 0.07 | 0.01 |
| 87 | 3.0 | 7.9 | 1.2 | | bal. | 1.0 | 0.12 | 0.19 | Al: 0.4 + Ga: 0.08 | 5.8 | 0.09 | 0.08 | 0.01 |
| 88 | 3.0 | 7.9 | 1.2 | | bal. | 1.0 | 0.20 | 0.19 | Al: 0.4 + Ga: 0.08 | 5.8 | 0.10 | 0.07 | 0.01 |
| 89 | 3.0 | 7.9 | 1.2 | | bal. | 1.0 | 0.30 | 0.19 | Al: 0.4 + Ga: 0.08 | 5.8 | 0.10 | 0.08 | 0.01 |
| 90 | 3.0 | 7.9 | 1.2 | | bal. | 1.0 | 0.40 | 0.20 | Al: 0.4 + Ga: 0.08 | 5.8 | 0.10 | 0.07 | 0.01 |

Also, besides hydrogen and the other elements shown in Table 7, Si, Ca, La, Ce and so on were sometimes detected. Specifically, Si could have come from a crucible that was used to melt the ferroboron material and the alloy together. Ca, La and Ce could have come from the rare-earth material. And Cr could have come from iron. In any case, it is impossible to eliminate these impurity elements altogether.

The sintered body thus obtained was thermally treated at various temperatures for an hour within an Ar atmosphere and then cooled. The heat treatment was carried out with the temperature varied according to the composition. Also, on some samples, the heat treatment was conducted three times at mutually different temperatures.

The magnetic properties and the textures of the sintered bodies were evaluated by the same techniques as the ones adopted in Example 1. The following Table 8 summarizes the crystal grain size distribution of the magnet, the area ratio of crystals with equivalent circle diameters of 5 μm or less, the area ratio of crystals with equivalent circle diameters of more than 12 μm, the fine powder particle size D50, the sintering process temperature, the sintering process time, and the magnetic properties of the samples shown in Table 7.

TABLE 8

| | | Sintering condition | | Crystal grain size area ratio (%) | | Magnetic properties | | |
|---|---|---|---|---|---|---|---|---|
| No. | Fine powder D50 (μm) | Temperature (° C.) | Kept sintered for | ≦5 μm | >12 μm | $B_r$ (T) | $H_{cJ}$ (kA/m) | $(BH)_{max}$ (kJ/m$^3$) |
| 81 | 3.3 | 1000 | 4 hrs. | 89 | 0 | 1.322 | 1613 | 341 |
| 82 | 3.2 | 1000 | 4 hrs. | 90 | 0 | 1.320 | 1645 | 340 |
| 83 | 3.4 | 1000 | 4 hrs. | 88 | 0 | 1.319 | 1653 | 337 |
| 84 | 3.3 | 1000 | 4 hrs. | 90 | 0 | 1.319 | 1650 | 337 |
| 85 | 3.4 | 1000 | 4 hrs. | 91 | 0 | 1.300 | 1568 | 322 |
| 86 | 3.3 | 1000 | 4 hrs. | 90 | 0 | 1.364 | 1851 | 362 |
| 87 | 3.3 | 1000 | 4 hrs. | 88 | 0 | 1.364 | 1862 | 361 |
| 88 | 3.5 | 1000 | 4 hrs. | 87 | 0 | 1.362 | 1849 | 361 |
| 89 | 3.3 | 1000 | 4 hrs. | 89 | 0 | 1.361 | 1838 | 359 |
| 90 | 3.4 | 1000 | 4 hrs. | 91 | 0 | 1.338 | 1803 | 344 |

Samples Nos. 85 and 90 had a relatively high Cu mole fraction of 0.40 at % but had lower remanence $B_r$ and lower coercivity $H_{cJ}$ than Samples Nos. 84 and 89, respectively.

INDUSTRIAL APPLICABILITY

As a predetermined amount of Mn has been added to an R-T-Cu—Mn—B based sintered magnet according to the present invention, an increased amount of Cu can be added to the magnet compared to a conventional composition. Thus, the magnet of the present invention can have increased coercivity without decreasing its remanence $B_r$ significantly. As a result, the magnetization of the magnet hardly decreases even with heat and its thermal resistance increases significantly. That is why the magnet of the present invention can be used effectively to make a motor, in particular.

The invention claimed is:

1. An R-T-Cu—Mn—B based sintered magnet comprising:

12.0 at % to 15.0 at % of R, which is at least one of the rare-earth elements that include Y and of which at least 50 at % is Pr and/or Nd;

5.5 at % to 6.5 at % of B;

0.08 at % to 0.35 at % of Cu;

0.04 at % to less than 0.15 at % of Mn;

at most 2 at % (including 0 at %) of M, which is one, two, or more elements that are selected from the group consisting of Al, Ti, V, Cr, Ni, Zn, Ga, Zr, Nb, Mo, Ag, In, Sn, Hf, Ta, W, Au, Pb and Bi; and T as the balance, which is either Fe alone or Fe and Co and of which at most 20 at % is Co if T includes both Fe and Co.

2. The R-T-Cu—Mn—B based sintered magnet of claim 1, wherein the main phase of the magnet is an $R_2T_{14}B$ type compound.

3. The R-T-Cu—Mn—B based sintered magnet of claim 2, wherein the crystal grain size of the main phase is represented by an equivalent circle diameter of 12 μm or less.

4. The R-T-Cu—Mn—B based sintered magnet of claim 2, wherein the combined area of portions of the main phase, of which the crystal grain sizes are represented by equivalent circle diameters of 8 μm or less, accounts for at least 70% of the overall area of the main phase.

5. The R-T-Cu—Mn—B based sintered magnet of claim 2, wherein the combined area of portions of the main phase, of which the crystal grain sizes are represented by equivalent circle diameters of 5 μm or less, accounts for at least 80% of the overall area of the main phase.

6. The R-T-Cu—Mn—B based sintered magnet of claim 3, wherein the combined area of portions of the main phase, of which the crystal grain sizes are represented by equivalent circle diameters of 8 μm or less, accounts for at least 70% of the overall area of the main phase.

7. The R-T-Cu—Mn—B based sintered magnet of claim 3, wherein the combined area of portions of the main phase, of which the crystal grain sizes are represented by equivalent circle diameters of 5 μm or less, accounts for at least 80% of the overall area of the main phase.

* * * * *